US009336713B2

(12) United States Patent
Nam et al.

(10) Patent No.: US 9,336,713 B2
(45) Date of Patent: May 10, 2016

(54) ORGANIC LIGHT EMITTING DISPLAY AND DRIVING METHOD THEREOF

(71) Applicant: LG Display Co., Ltd., Seoul (KR)

(72) Inventors: Woojin Nam, Goyang-si (KR); Jongsik Shim, Seoul (KR); Hongjae Shin, Seoul (KR); Minkyu Chang, Seoul (KR)

(73) Assignee: LG Display Co., Ltd., Seoul (KR)

( * ) Notice: Subject to any disclaimer, the term of this patent is extended or adjusted under 35 U.S.C. 154(b) by 305 days.

(21) Appl. No.: 13/668,038

(22) Filed: Nov. 2, 2012

(65) Prior Publication Data

US 2014/0062331 A1 Mar. 6, 2014

(30) Foreign Application Priority Data

Aug. 30, 2012 (KR) ..... 10-2012-0095604

(51) Int. Cl.
*H05B 37/02* (2006.01)
*G09G 3/32* (2016.01)

(52) U.S. Cl.
CPC ..... *G09G 3/3233* (2013.01); *G09G 2300/0819* (2013.01); *G09G 2300/0852* (2013.01); *G09G 2300/0861* (2013.01); *G09G 2320/0223* (2013.01); *G09G 2320/043* (2013.01); *G09G 2320/045* (2013.01)

(58) Field of Classification Search
CPC ..... H05B 33/0896; H05B 33/0815; H05B 33/0818; H05B 33/0884; H05B 33/0809; H05B 37/029; H05B 37/02; G09G 3/325
USPC ..... 315/45, 204, 226, 224, 294, 307
See application file for complete search history.

(56) References Cited

U.S. PATENT DOCUMENTS 7,417,383 B2 * 8/2008 Ahn ..... H05B 41/2828 315/291
9,270,263 B2 * 2/2016 Iwaki ..... H03K 17/693
2005/0285825 A1 * 12/2005 Eom et al. ..... 345/76
2006/0044230 A1 * 3/2006 Eom ..... 345/76
2008/0043005 A1 * 2/2008 Kanda ..... G09G 3/3233 345/204

(Continued)

FOREIGN PATENT DOCUMENTS

KR 10-2010-0053233 A 5/2010

OTHER PUBLICATIONS

European Patent Office, European Search Report and Opinion, European Patent Application No. 12007398.6-1904, Jul. 5, 2013, eight pages.
Korean Intellectual Property Office, Office Action, Korean Patent Application No. No. 10-2012-0095604, Oct. 30, 2014, five pages [with concise explanation of relevance in English].

*Primary Examiner* — Douglas W Owens
*Assistant Examiner* — Syed M Kaiser
(74) *Attorney, Agent, or Firm* — Fenwick & West LLP

(57) ABSTRACT

An organic light emitting display comprises: a driving TFT comprising a gate connected to a node B, a drain connected to an input terminal of high-potential cell driving voltage, and a source connected to the organic light emitting diode through a node C; a first switching TFT for switching the current path between a node A and the node B in response to a light emission control signal; a second switching TFT for initializing the node C in response to an initialization signal; a third switching TFT for initializing either the node A or the node B in response to the initialization signal; a fourth switching TFT for switching the current path between a data line and the node B in response to a scan signal; a compensation capacitor connected between the node B and the node C.

14 Claims, 14 Drawing Sheets

(56) References Cited

U.S. PATENT DOCUMENTS

2008/0158211 A1* 7/2008 Kwon ..... G01J 1/32 345/207
2008/0238908 A1* 10/2008 Sakamoto ..... G09G 3/2965 345/211
2009/0072757 A1* 3/2009 Yamazaki ..... H05B 33/0812 315/291
2010/0033511 A1* 2/2010 Yamashita et al. ..... 345/690
2011/0157143 A1* 6/2011 Choi ..... G09G 3/3233 345/212
2012/0154352 A1* 6/2012 Yamashita ..... G09G 3/3233 345/207

* cited by examiner

ORGANIC LIGHT EMITTING DISPLAY AND DRIVING METHOD THEREOF

CROSS-REFERENCE TO RELATED APPLICATIONS

This application claims the benefit of Korean Patent Application No. 10-2012-0095604 filed on Aug. 30, 2012, which is incorporated by reference in its entirety.

BACKGROUND OF THE INVENTION

1. Technical Field of the Invention

This document relates to an active matrix type organic light emitting display and a driving method thereof.

2. Discussion of the Related Art

An active matrix type organic light emitting display includes a self-luminous organic light emitting diode (hereinafter, referred to as "OLED"), and is advantageous in that it has high response speed, luminous efficiency, luminance, and a large viewing angle.

An OLED is a self-luminous element having the structure as shown in FIG. 1. The OLED includes an anode, a cathode, and an organic compound layer HIL, HTL, EML, ETL, and EIL formed between the anode and the cathode. The organic compound layer includes a hole injection layer HIL, a hole transport layer HTL, an emission layer EML, an electron transport layer ETL and an electron injection layer EIL. If drive voltages are applied to the anode electrode and the cathode electrode, holes within the hole injection layer HIL and electrons within the electron transport layer ETL respectively move to the emission layer EML to form excitons. As a result, the emission layer EML emits a visible ray.

The organic light emitting display includes pixels each including an OLED which area arranged in a matrix form, and controls the luminance of the pixels according to the gray scale of video data. Each pixel includes a driving thin film transistor (TFT) for controlling the driving current flowing through the OLED in accordance with a gate-source voltage, a capacitor for keeping a gate potential of the driving TFT constant during a frame, and a switching TFT for storing a data voltage in the capacitor in response to a gate signal. The luminance of a pixel is proportional to the magnitude of the driving current that flows through the OLED.

The organic light emitting display is disadvantageous in that the driving TFTs of the pixels have different threshold voltages depending on where they are formed, due to a process deviation or the like, or the electrical properties of the driving TFTs are deteriorated due to a gate-bias stress which occurs with the elapse of driving time. To solve this problem, Korean Laid-Open Patent Publication No. 10-2005-0122699 discloses a pixel circuit of an organic light emitting display which detects, as the threshold voltage of a driving TFT, a gate-source voltage at which a drain-source current becomes sufficiently small by a diode-connecting the driving TFT, and compensates a data voltage by the detected threshold voltage. The pixel circuit uses a light emission control TFT serially connected between the driving TFT and an OLED in order to turn off light emission of the OLED upon detecting the threshold voltage of the driving TFT.

However, the conventional pixel circuit of an organic light emitting display is problematic in that its capability of compensating for the threshold voltage of the driving TFT is low and some TFTs show low reliability due to the following reasons.

First, when detecting the threshold voltage of a driving TFT of a diode structure, a gate-drain voltage becomes "0V", and thus a minimum threshold voltage (for n-type) or maximum detectable threshold voltage (for p-type) is "0V". Therefore, according to a conventional method for detecting the threshold voltage of a driving TFT by diode connection, a pixel circuit using a n-type TFT can detect the threshold voltage of the driving TFT only when the threshold voltage of the driving TFT has a positive value, and a pixel circuit using a p-type TFT can detect the threshold voltage of the driving TFT only when the threshold voltage of the driving TFT has a negative value. In other words, a conventional method for compensating a threshold voltage cannot be applied if the threshold voltage of the driving TFT in the pixel circuit using a p-type TFT has a negative value, and also cannot be applied if the threshold voltage of the driving TFT in the pixel circuit using an n-type TFT has a positive value.

Second, a parasitic capacitance exists between a TFT of a pixel circuit and a signal line. The parasitic capacitance causes a kick-back voltage when a gate signal applied to the TFT is turned off. If the kick-back voltage is high, a detected threshold voltage cannot be properly maintained but is distorted, thus decreasing the accuracy of compensation. To increase the accuracy of threshold voltage compensation, the gate and source voltages of the driving TFT need to be increased further when detecting a threshold voltage, by taking distortion in subsequent steps into consideration. However, the conventional method for threshold voltage compensation cannot improve the accuracy of compensation because a fixed potential is applied to the gate of the driving TFT.

Third, the light emission control TFT serially connected between the driving TFT and the OLED is turned off in a period during which threshold voltage sensing and data programming are performed, and turned on in a period during which light emission occurs. Assuming that the period during which threshold voltage sensing and data programming are performed is a first period, and the period during which light emission occurs is a second period, a proportion that the second period occupies in one frame is much larger than that of the first period. Since the light emission control TFT in the pixel circuit is kept turned on during the entire emission period, the reliability of the light emission control TFT is lowered due to a deterioration caused by a gate-bias stress.

SUMMARY

Accordingly, it is an object of the present invention to provide an organic light emitting display and a driving method thereof which increase the capability of compensating for the threshold voltage of a driving TFT and improve the reliability of TFTs in the pixel circuit.

To accomplish the above aspect, according to an exemplary embodiment of the present invention, there is provided an organic light emitting display comprising: an organic light emitting diode; a driving TFT comprising a gate connected to a node B, a drain connected to an input terminal of high-potential cell driving voltage, and a source connected to the organic light emitting diode through a node C, and for controlling the current applied to the organic light emitting diode; a first switching TFT for switching the current path between a node A and the node B in response to a light emission control signal; a second switching TFT for initializing the node C to an initialization voltage in response to an initialization signal; a third switching TFT for initializing either the node A or the node B to a reference voltage higher than the initialization voltage in response to the initialization signal; a fourth switching TFT for switching the current path between a data line and the node B in response to a scan signal; a compensation capacitor connected between the node B and the node C; and a storage capacitor connected between node A and node C.

To accomplish the above aspect, a driving method of an organic light emitting display comprising a driving TFT comprising a gate connected to a node B, a drain connected to an input terminal of high-potential cell driving voltage, and a source connected to the organic light emitting diode through a node C, and for controlling the current applied to the organic light emitting diode, the method comprising: initializing the node C to an initialization voltage in response to an initialization signal, and initializing the node B to a reference voltage higher than the initialization voltage in response to the initialization signal and a light emission control signal; stopping the supply of the initialization voltage and allowing the node B to float, and then detecting and storing the threshold voltage of the driving TFT by using a compensation capacitor connected between the node B and the node C; applying a data voltage to a node A connected to a storage capacitor in response to a scan signal; and transmitting the data voltage of the node A to the node B in response to the light emission control signal to compensate for the driving current applied to the organic light emitting diode, regardless of the threshold voltage, and causing the organic light emitting diode to emit light.

DETAILED DESCRIPTION

Hereinafter, an exemplary embodiment will be described with reference to FIGS. 2 to 10.

Figure 2:
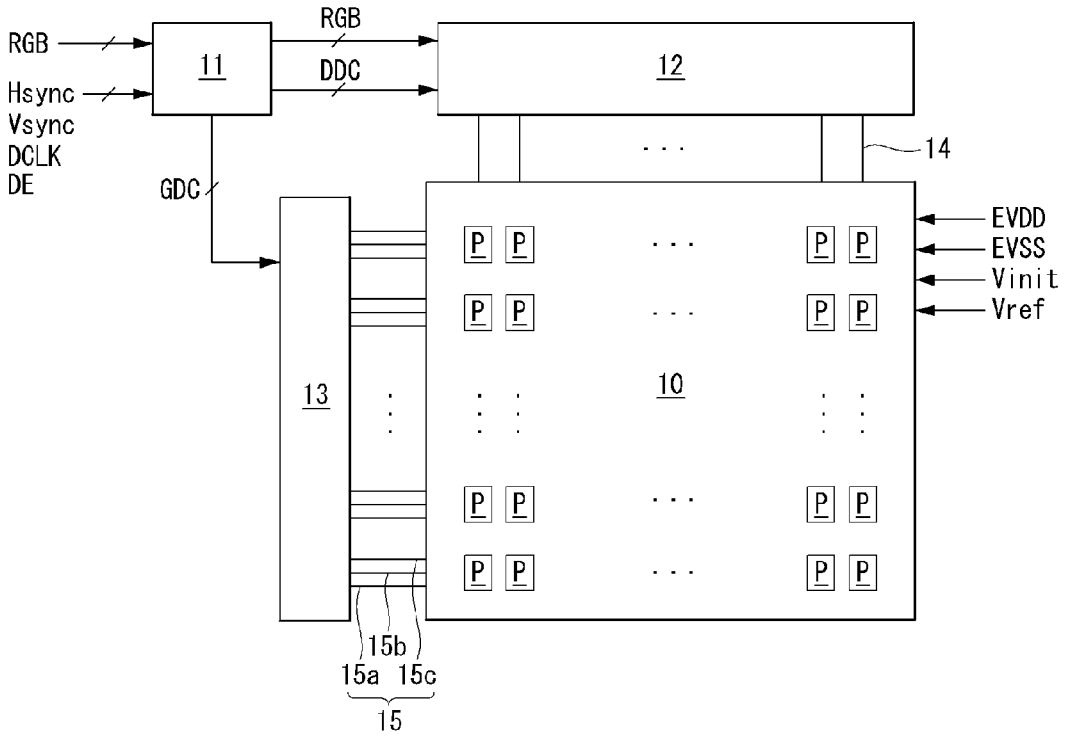
FIG. 2 shows an organic light emitting display according to one embodiment of the present invention.

FIG. 2 shows an organic light emitting display according to an exemplary embodiment of the present invention.

Referring to FIG. 2, the organic light emitting display according to the exemplary embodiment of the present invention comprises a display panel 10 having pixels P arranged in a matrix form, a data driving circuit 12 for driving data lines 14, a gate driving circuit 13 for driving gate line portions 15, and a timing controller 11 for controlling the driving timings of the data and gate driving circuits 12 and 13.

A plurality of data lines 14 and a plurality of gate line portions 15 cross each other on the display panel 10, and pixels P are disposed in a matrix form at crossing regions of the data lines 14 and the gate line portions 15. Each of the gate line portions 15 comprises a scan line 15*a*, an emission line 15*b*, and an initialization line 15*c*. Each pixel P is connected to a data line 14 and the three signal lines 15*a*, 15*b*, and 15*c* constituting a gate line portion 15. The pixels P are supplied with high-potential and low-potential cell driving voltages EVDD and EVSS, a reference voltage Vref, and an initialization voltage Vinit. The reference voltage Vref and the initialization voltage Vinit may be set lower than the low-potential cell driving voltage EVSS. The reference voltage Vref is set higher than the initialization voltage Vinit; especially, the difference between the reference voltage Vref and the initialization voltage Vinit may be set higher than the threshold voltage of a driving TFT. Each of the pixels P comprises an OLED, a driving TFT, four switching TFTs, and two capacitors according to one embodiment.

The pixel P of the present invention detects the threshold voltage of the driving voltage according to a source-follower method, instead of a conventional diode connection method. In the source-follower method, a compensation capacitor is connected between the gate and source of the driving TFT, and the source voltage of the driving TFT follows the gate voltage upon detecting the threshold voltage. Moreover, since the drain of the driving TFT is separated from the gate and supplied with the high-potential cell driving voltage EVDD, this source-follower method makes it possible to detect a negative threshold voltage value, as well as a positive threshold voltage value. The pixel P of the present invention allows the gate of the driving TFT to float upon sensing the threshold voltage of the driving TFT, and improves the threshold voltage compensation capability by using the compensation capacitor connected between the gate and source of the driving TFT and a parasitic capacitor of the driving TFT. By minimizing the on-duty of a light emission control signal applied to the pixel P of the present invention, any deterioration of the switching TFTs to be switched on in accordance with a light emission control signal can be minimized. A detailed configuration of the pixel P of the present invention will be described later in detail with reference to FIG. 3.

The TFTs constituting the pixel P may be implemented as oxide TFTs each including an oxide semiconductor layer. When electron mobility, process deviation, etc. are all considered, the oxide TFTs are advantageous for a large-sized display panel 10. In other embodiments, the semiconductor layers of the TFTS may be formed of amorphous silicon, polysilicon, etc. Although the following detailed description is made with respect to an n-type TFT, a p-type TFT is also applicable.

The timing controller 11 re-aligns digital video data RGB input from an external system board in accordance with the resolution of the display panel 10 to supply to the data driving circuit 12. The timing controller 11 generates a data timing control signal DDC for controlling an operating timing of the data driving circuit 12 and a gate timing control signal GDC for controlling an operating timing of the gate driving circuit 13 based on timing signals including a vertical synchronization signal Vsync, a horizontal synchronization signal Hsync, a dot clock signal DCLK, and a data enable signal DE.

The data driving circuit 12 converts the digital video data RGB input from the timing controller 11 based on the data control signal DDC into an analog data voltage and supplies it to the data lines 14.

The gate driving circuit 13 generates a scan signal, a light emission signal, and an initialization signal based on the gate control signal GDC. The gate driving circuit 13 supplies scan signals to the scan lines 15*a* in a line-sequential manner, supplies light emission control signals to the emission lines 15*b* in a line-sequential manner, and supplies initialization signals to the initialization lines 15*c* in a line-sequential manner. The gate driving circuit 13 may be formed directly on the display panel 10 in a GIP (Gate-driver In Panel) manner.

Figure 3:
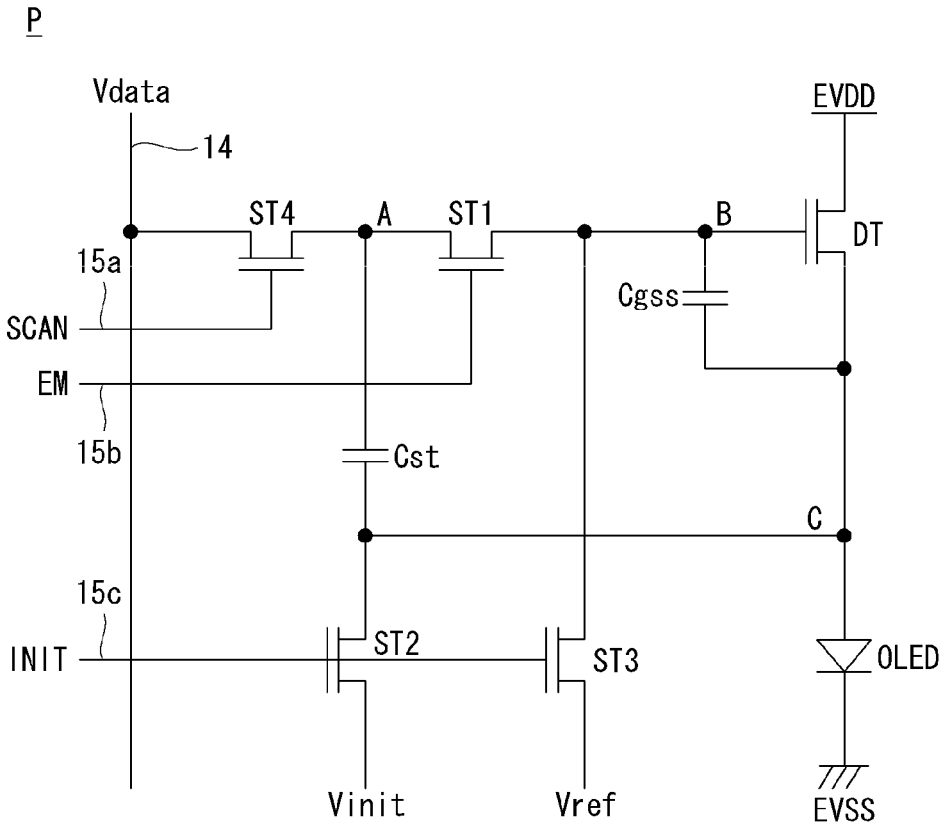
FIG. 3 shows an example of the pixel P of FIG. 2 according to one embodiment.

FIG. 3 shows an example of the pixel P of FIG. 2.

Referring to FIG. 3, the pixel P according to one embodiment comprises an OLED, a driving TFT (DT), first to fourth TFTs (ST1 to ST4), a compensation capacitor Cgss, and a storage capacitor Cst.

Figure 1:
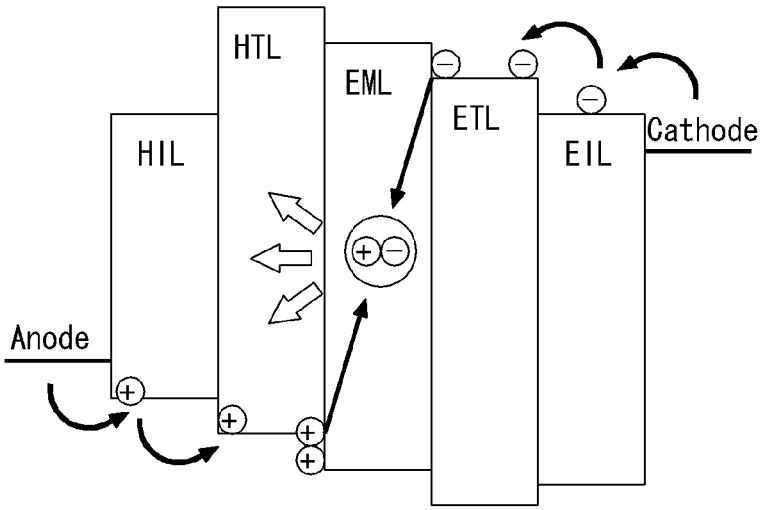
FIG. 1 is a view showing an organic light emitting diode and the principle of light emission thereof.

The OLED emits light by the driving current supplied from the driving TFT (DT). As shown in FIG. 1, multiple organic compound layers are formed between the anode and cathode of the OLED. The organic compound layers comprise a hole injection layer HIL, a hole transport layer a hole transport layer HTL, an emission layer EML, an electron transport layer ETL, and an electron injection layer EIL. The anode of the OLED is connected to a source electrode of the driving TFT (DT), and the cathode thereof is connected to an input terminal of low-potential cell driving voltage EVSS.

The driving TFT (DT) controls the driving current applied to the OLED by its gate-source voltage. The gate electrode of the driving TFT (DT) is connected to node B, the drain electrode thereof is connected to an input terminal of high-potential cell driving voltage EVDD, and the source electrode thereof is connected to node C.

The first switching TFT (ST1) switches the current path between node A and node B in response to a light emission control signal EM. The first switching TFT (ST1) is turned on to transmit the data voltage Vdata stored in node A to node B. The gate electrode of the first switching TFT (ST1) is connected to the emission line 15*b*, its drain electrode is connected to node A, and its source electrode is connected to node B.

The second switching TFT (ST2) switches the current path between an input terminal of initialization voltage Vinit and node C. The second switching TFT (ST2) is turned on to supply an initialization voltage Vinit to node C. The gate electrode of the second switching TFT (ST2) is connected to the initialization line 15*c*, its drain electrode is connected to the input terminal of initialization voltage Vinit, and its source electrode is connected to node C.

The third switching TFT (ST3) switches the current path between an input terminal of reference voltage Vref and node B in response to an initialization signal INIT. The third switching TFT (ST3) is turned on to supply a reference voltage Vref to node B. The gate electrode of the third switching TFT (ST3) is connected to the initialization line 15*c*, its drain electrode is connected to the input terminal of reference voltage Vref, and its source electrode is connected to node B.

The fourth switching TFT (ST4) switches the current path between the data line 14 and node A in response to a scan signal SCAN. The fourth switching TFT (ST4) is turned on to supply a data voltage Vdata to node A. The gate electrode of the fourth switching TFT is connected to the scan lines 15*a*, its drain electrode is connected to the data line 14, and its source electrode is connected to node A.

The compensation capacitor Cgss is connected between node B and node C. The compensation capacitor Cgss enables the source-follower method upon detecting the threshold voltage of the driving TFT (DT).

The storage capacitor Cst is connected between node A and node C. The storage capacitor Cst functions to store the data voltage Vdata input into node A and then transmit it to node C.

Figure 4:
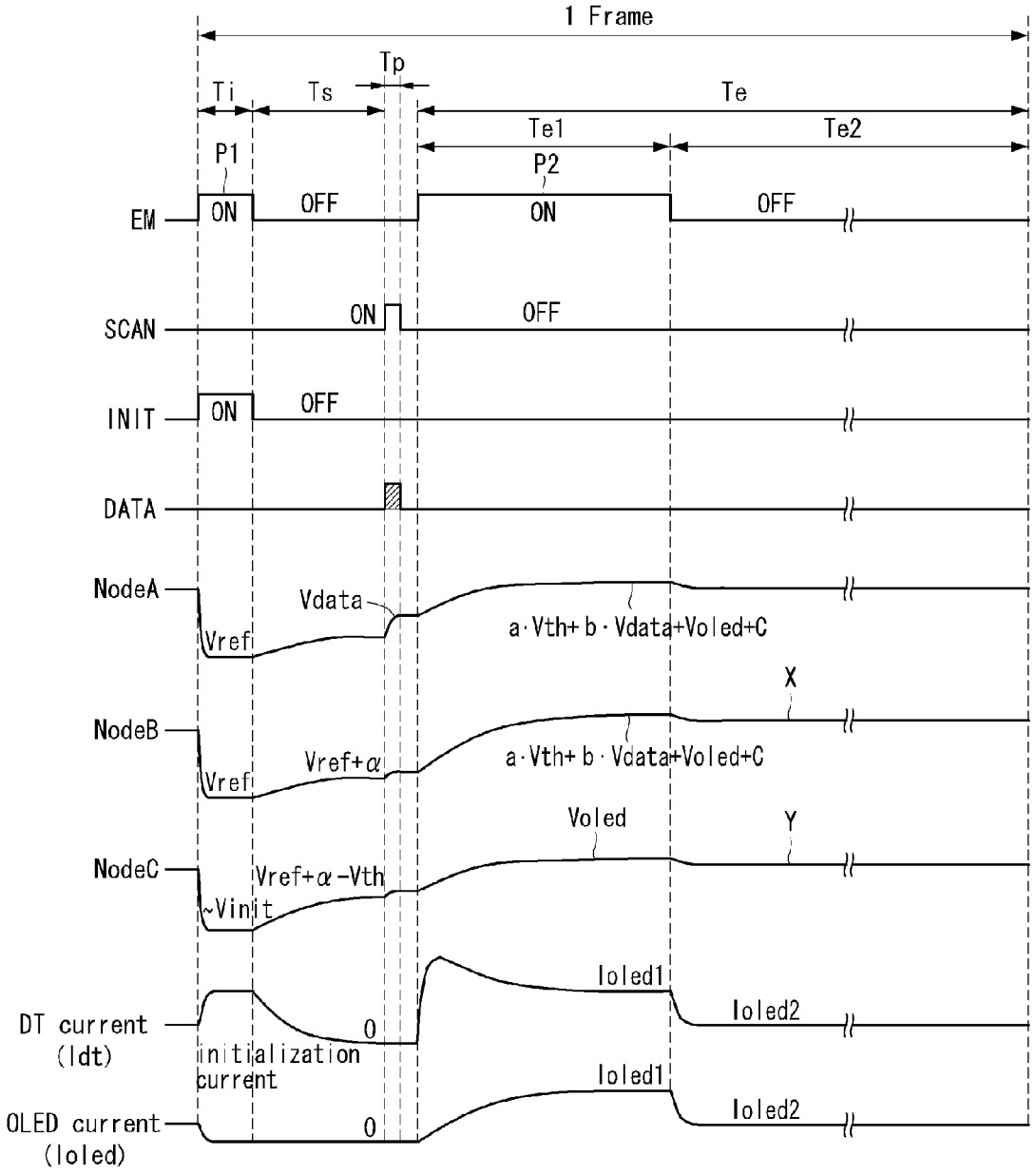
FIG. 4 is a waveform diagram showing signals applied to the pixel of FIG. 3, potential changes of nodes A, B, and C responsive to these signals, and changes in the current flowing through the driving TFT and the OLED.

FIG. 4 is a waveform diagram showing signals EM, SCAN, INIT, and DATA applied to the pixel P of FIG. 3, potential changes of nodes A, B, and C responsive to these signals, and changes in the current flowing through the driving TFT (DT) and the OLED. FIGS. 5*a* to 5*e* respectively show circuits of the pixel P in an initialization period Ti, a sensing period TS, a programming period Tp, and first and second emission periods Te1 and Te2, respectively. In FIGS. 5*a* to 5*e*, the activation of the elements is indicated by solid lines, and the deactivation of the elements is indicated by dotted (i.e., dashed) lines.

Referring to FIG. 4, the operation of the pixel P according to one embodiment is divided into an initialization period Ti for initializing nodes A, B, and C to a specific voltage, a sensing period Ts for detecting and storing the threshold voltage of the driving TFT (DT), a programming period Tp for applying a data voltage Vdata, and an emission period Te for compensating the driving current applied to the OLED using the threshold voltage and the data voltage Vdata, regardless of the threshold voltage. The emission period Te is subdivided into first and second emission periods Te1 and Te2.

Figure 5A:
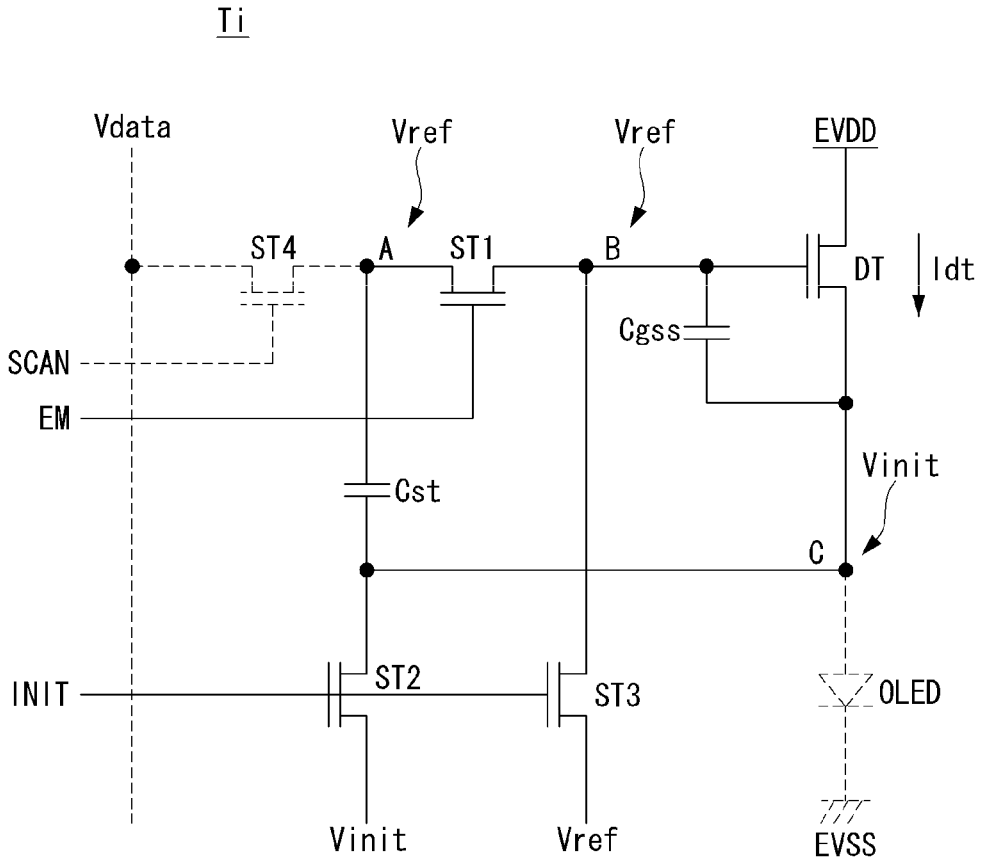
FIG. 5*a* is a circuit diagram of the pixel corresponding to an initialization period according to one embodiment.

Referring to FIG. 4 and FIG. 5*a*, the second switching TFT (ST2) is turned on in response to an initialization signal INIT of ON level in the initialization period Ti to supply an initialization voltage Vinit to node C, and the third switching TFT (ST3) is turned on in response to the initialization signal INIT of ON level to supply a reference voltage Vref to node B. The first switching TFT (ST1) is turned on in response to a light emission control signal EM of ON level to supply the reference voltage Vref to node A. The fourth switching TFT (ST4) is turned off in response to a scan signal SCAN of OFF level. The reference voltage Vref is set higher than the initialization voltage Vinit to make the driving TFT (DT) conductive. Also, the initialization voltage Vinit is set to an appropriate low value to prevent the light emission of the OLED in periods Ti, Ts, and Tp other than the emission period Te. For example, if the high-potential cell driving voltage EVDD is set to 20 V, and the low-potential cell driving voltage EVSS is set to 0 V, the reference voltage Vref and the initialization voltage Vinit may be set to −1 V and −5 V, respectively.

In the initialization period Ti, nodes A and B are charged with the reference voltage Vref, and node C is charged with the initialization voltage Vinit. During the initialization period Ti, the gate-source voltage of the driving TFT (DT) is higher than the threshold voltage. Therefore, the driving TFT (DT) is turned on, and the current Idt flowing through the driving TFT (DT) has an appropriate initialization value.

Figure 5B:
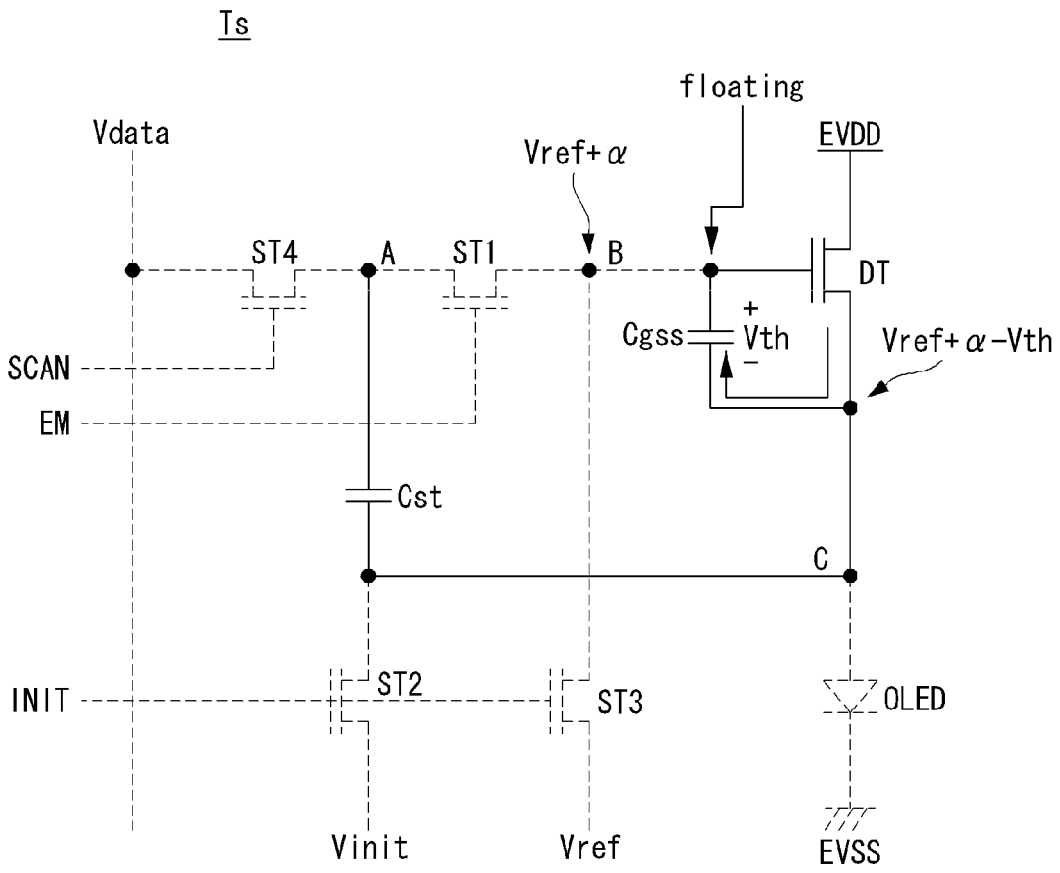
FIG. 5*b* is a circuit diagram of the pixel corresponding to a sensing period according to one embodiment.

Referring to FIG. 4 and FIG. 5*b*, in the sensing period Ts, the first switching TFT (ST1) is turned off by the light emission control signal EM of OFF level, the second and third switching TFTs (ST2 and ST3) are turned off by the initialization signal NIT of OFF level, and the fourth switching TFT (ST4) is turned off by the scan signal SCAN of OFF level.

In the sensing period Ts, the voltage of node C rises as the supply of the initialization voltage Vinit is stopped, and a result the current Idt flowing through the driving TFT (DT) gradually decreases. When the gate-source voltage of the driving TFT (DT) reaches the threshold voltage Vth, the driving TFT (DT) is turned off. At this point, the threshold voltage Vth of the driving TFT (DT) is detected in the source-follower method, and reflected on the potential of node C. In the present invention, even a threshold voltage Vth having a positive value, as well as a negative value, can be detected according to the source-follower method, regardless of whether the driving TFT is an n-type TFT or p-type TFT. The potential of node C rises from the initialization voltage Vinit up to "(Vref-Vth)+α" (hereinafter, referred to as an "intermediate source voltage"). In the sensing period Ts, node B is allowed to float. In this case, when the potential of node C rises to the "intermediate source voltage", the potential of node B also rises to "Vref+α" (hereinafter, referred to as an "intermediate gate voltage") due to a capacitor coupling effect. "α" included in the "intermediate source voltage" and "intermediate gate voltage" is an amplification compensation factor, which increases in proportion to the threshold voltage of the driving TFT (DT). An additional increase in the potentials of both nodes B and C plays an important role in improving the accuracy of compensation of the threshold voltage Vth in a subsequent emission period Te. "α" on which the threshold voltage compensation capability depends on is a design value which is set in consideration of distortion of threshold voltage compensation caused by a kick-back voltage. The value of "α" can be adjusted by a parasitic capacitor of the driving TFT (DT) and the compensation capacitor Cgss. By properly adjusting the value of "α", the threshold voltage Vth can be efficiently compensated for without being affected by the parasitic capacitor of the driving TFT (DT). This will be described later in FIG. 6. The threshold voltage Vth of the driving TFT (DT) detected in the sensing period Ts is stored and maintained in node C by the compensation capacitor Cgss. The threshold voltage Vth of the driving TFT (DT) stored and maintained in node C may have a negative voltage value of "−Vth".

Figure 5C:
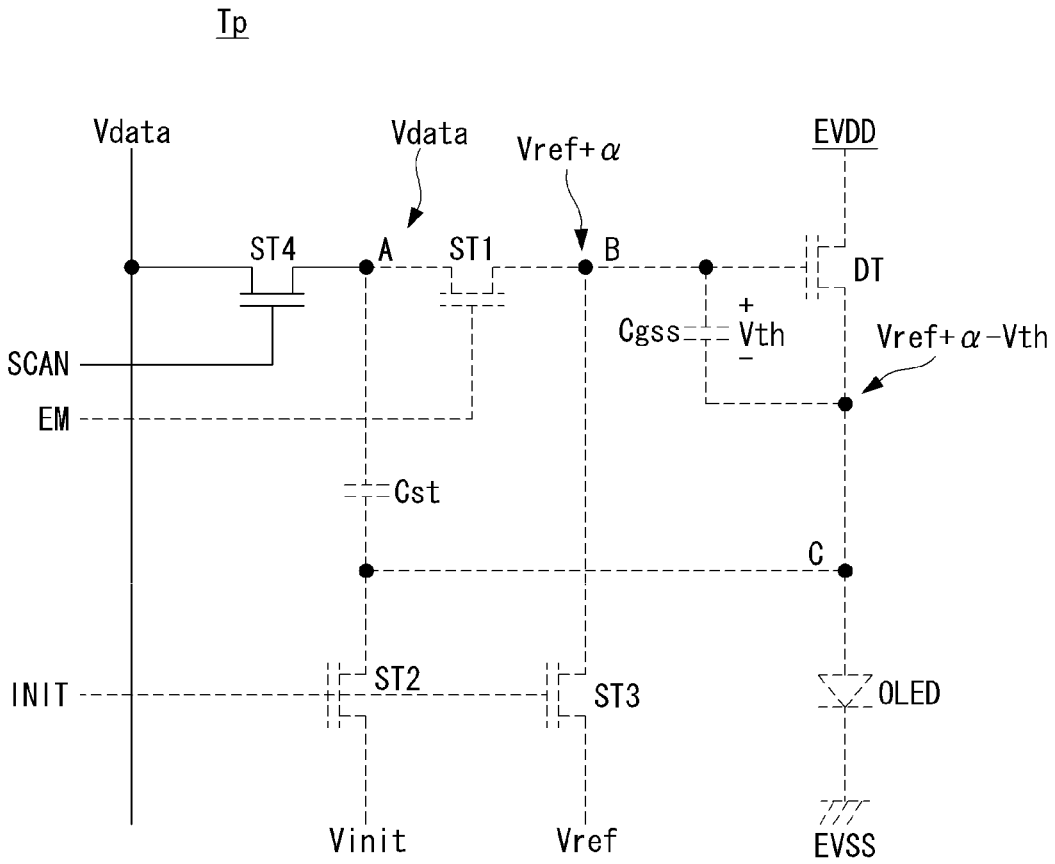
FIG. 5*c* is a circuit diagram of the pixel corresponding to a programming period according to one embodiment.

Referring to FIG. 4 and FIG. 5*c*, in the programming period Tp, the fourth switching TFT (ST4) is turned on by a scan signal SCAN of ON level to supply a data voltage Vdata to node A. The first switching TFT (ST1) is turned off by the light emission signal EM of OFF level, and the second and third switching TFTs (ST2 and ST3) are turned off by the initialization signal INIT of OFF level. In the programming period Tp, nodes B and C are separated from node A by a TFT or capacitor, and therefore maintains nearly the same potential as that in the sensing period Ts (although the potential is slightly changed due to the capacitor coupling effect, but almost ignorable).

Figure 5D:
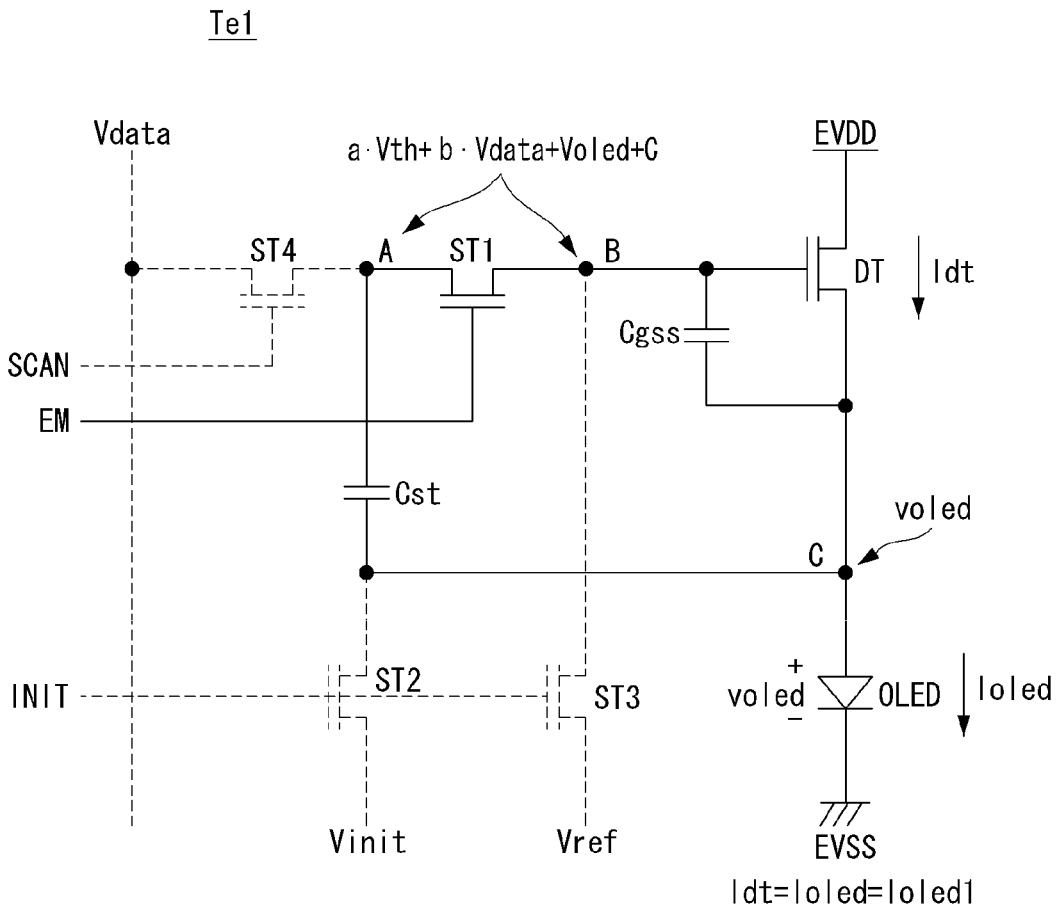
FIG. 5*d* is a circuit diagram of the pixel corresponding to a first emission period according to one embodiment.

Referring to FIG. 4 and FIG. 5*d*, in the first emission period Te1, the first switching TFT (ST1) is turned on by the light emission signal (EM) of ON level to transmit the data voltage Vdata charged in node A to node B. The second and third switching TFTs (ST2 and ST3) are turned off by the initialization signal INIT of OFF level, and the fourth switching TFT (ST4) is turned off by the scan signal SCAN of OFF level.

In the first emission period Te1, the driving TFT (DT) is turned on by the data voltage Vdata transmitted to node B. The current Idt flowing through the driving TFT (DT) causes the potential of node C to increase to "Voled" by which the OLED is made conductive, and as a result, the OLED is turned on. When the OLED is turned on, the currents Idt and Ioled flowing through the OLED and the driving TFT (DT) become equal. When the first driving current Ioled1 flows through the OLED, the potential of node C is boosted to "Voled" (hereinafter, referred to as a "first final source voltage"), and the potentials of nodes A and B are all boosted to "a*Vth+b*Vdata+Voled+C" (hereinafter, referred to as a "first final gate voltage"). In the first final gate voltage, "a" multiplied by the threshold voltage Vth is a constant affected by parasitic capacitors (Cgs and Cgd of FIG. 6) of the driving TFT (DT), which is ideally "1", but actually "less than 1" because of the parasitic capacitors. In this case, in the equation of the first driving current Ioled1, the factors of the threshold voltage Vth are not completely compensated for, as shown in $\beta/2\ (Vgs-Vth)2=\beta/2\ (a*Vth+b*Vdata+C-Vth)2$, whereby the threshold voltage compensation capability is lowered. To completely compensate for the threshold voltage, "a" multiplied by the threshold voltage Vth has to be 1. In the present invention, "a" multiplied by the threshold voltage Vth becomes 1 by properly selecting the amplification compensation factor "α" included in the "intermediate source voltage" and the "intermediate gate voltage". By this, the threshold voltage compensation capability is improved. In the above equation, "β" denotes a constant determined by the mobility of the driving TFT (DT), a parasitic capacitance, and a channel size, "Vgs" denotes the gate-source voltage of the driving TFT (DT), "b" denotes a distribution coefficient caused by the compensation capacitor Cgss, the storage capacitor Cst, and the parasitic capacitor of the driving TFT (DT), and "C" denotes a constant for simplifying the equation of the first final source voltage.

Figure 5E:
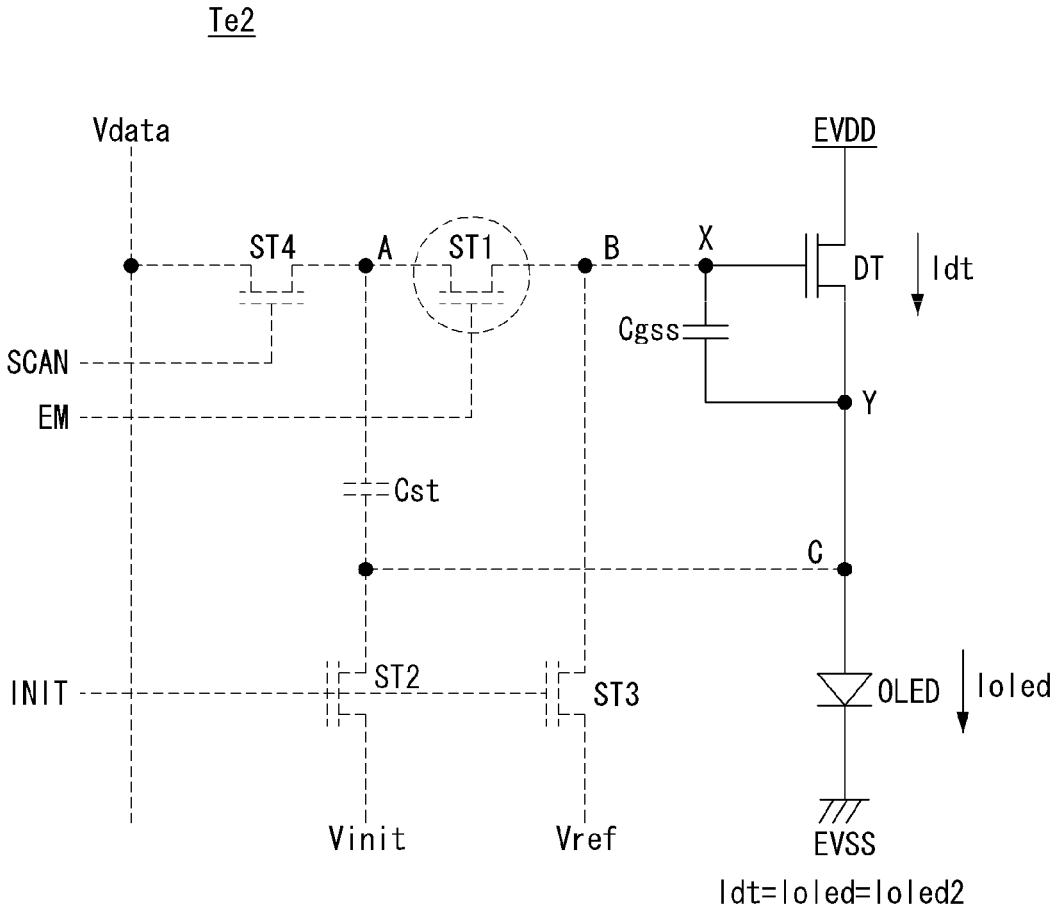
FIG. 5*e* is a circuit diagram of the pixel corresponding to a second emission period according to one embodiment.

Referring to FIG. 4 and FIG. 5*e*, in the second emission period Te2, the first switching TFT (ST1) is turned off by the light emission control signal EM of OFF level, the second and third switching TFTs (ST2 and ST3) are turned off by the initialization signal NIT of OFF level, and the fourth switching TFT (ST4) is turned off by the scan signal SCAN of off level.

The second emission period Te2 is a period required to prevent deterioration of the first switching TFT (ST1) to which the light emission control signal EM is applied. To this end, the light emission control signal EM is maintained at the OFF level during the second emission period Te2, unlike the conventional art. Since it is maintained at the OFF level in the second emission period Te2, the light emission control signal EM has a first pulse P1 corresponding to the initialization period Ti and a second pulse P2 corresponding to the first emission period Te1. A proportion that the second emission period TE2 occupies in one frame is much larger than those of the other periods Ti, Ts, Tp, and Te1. Since the first switching TFT (ST1) is kept turned off in the second emission period Te2, it is free of any degradation caused by a gate bias stress.

When the first switching TFT (ST1) is turned off in the second emission period Te2, the potentials of nodes B and C (needless to say, the potential of node A also changes) are reduced to a second final gate voltage "X" and a second final source voltage "Y", respectively. At this point, compensation of the driving TFT (DT) is maintained the same as that in the first emission period Te1, and the currents Idt and Ioled flowing through the OLED and the driving TFT (DT) become equal, that is, the second driving current Ioled2. The gray scale of the pixel is determined by integral values of the first and second driving currents Ioled1 and Ioled2.

Figure 6:
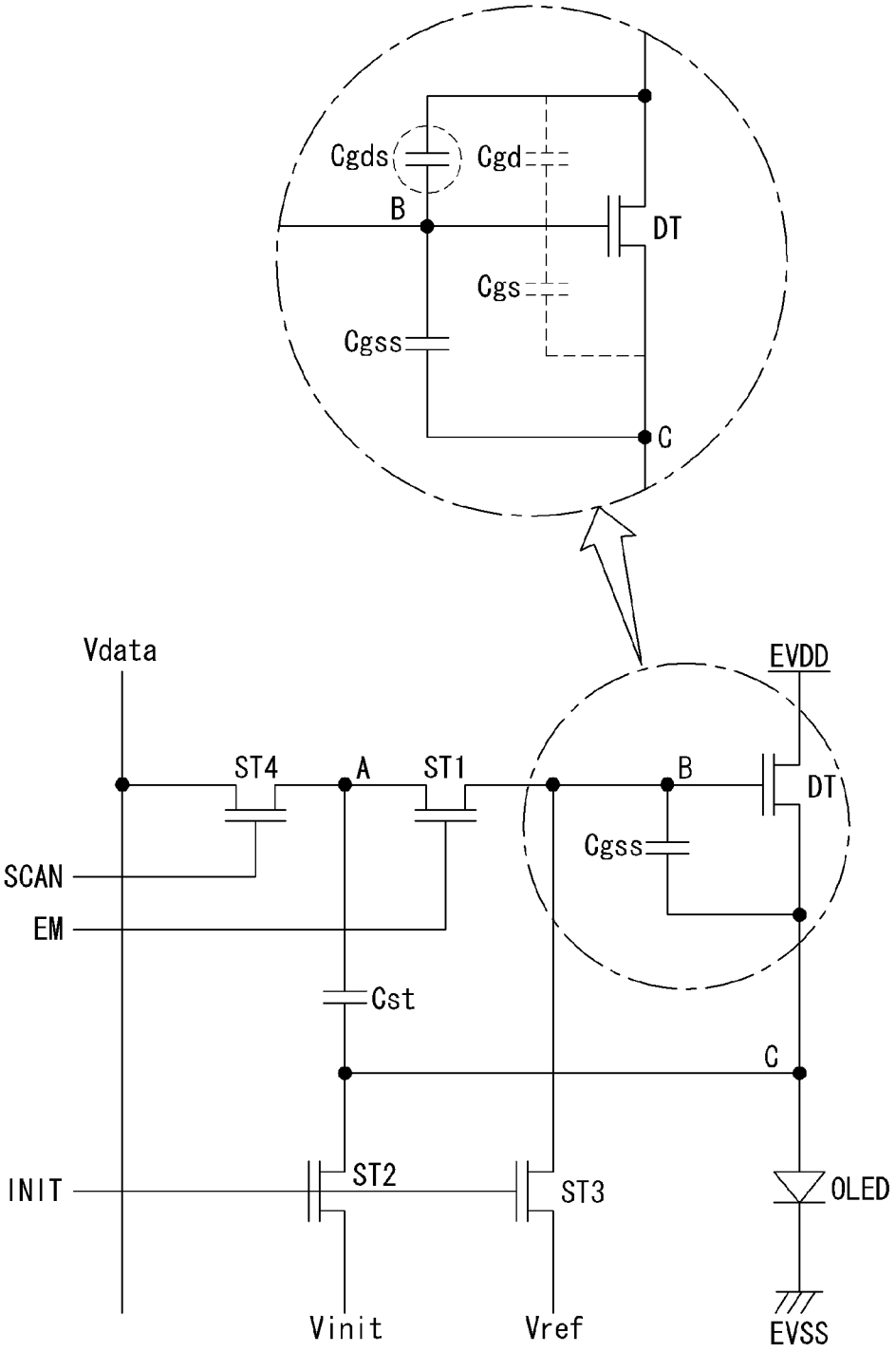
FIG. 6 shows a design method of a driving TFT for improving the threshold voltage compensation capability according to one embodiment.

FIG. 6 shows a design method of a driving TFT (DT) for improving the threshold voltage compensation capability according to one embodiment.

Referring to FIG. 6, a first parasitic capacitor Cgs is formed between the gate and source of the driving TFT (DT), and a second parasitic capacitor Cgd is formed between the gate and drain of the driving TFT (DT). In the present invention, the capacitance of the compensation capacitor Cgss and first parasitic capacitor Cgs connected in parallel and the capacitance of the second parasitic capacitor Cgd connected in series to these capacitors Cgss and Cgs can be adjusted in order to improve the threshold voltage compensation capability. By adjusting the capacitances of the above-mentioned capacitors, the above-described "α" on which the threshold voltage compensation capability depends is determined. In the present invention, the design size of the first and second parasitic capacitors Cgs and Cgd, in addition to the design size of the compensation capacitor Cgss, can be adjusted. Moreover, in the present invention, an adjustment capacitor Cgds may be further formed between the gate and drain of the driving TFT (DT), in order to supplement the capacitance of the second parasitic capacitor Cgd, if required.

Figure 7:
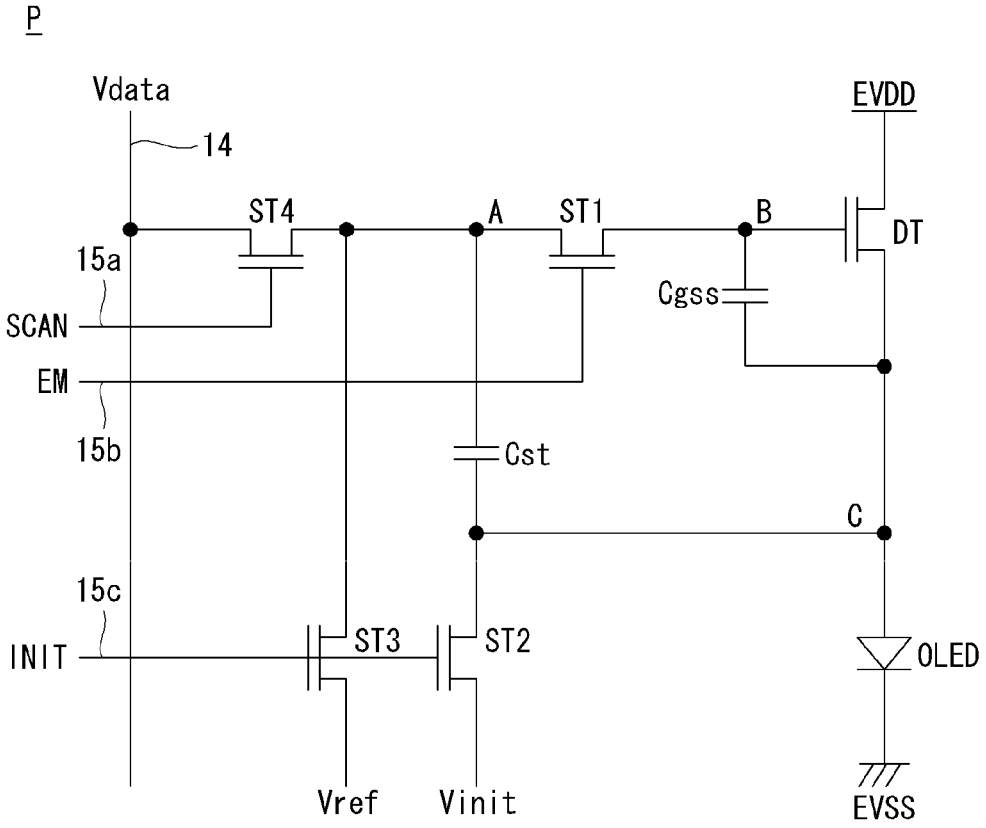
FIG. 7 shows an example of the pixel P of FIG. 2 according to one embodiment.

FIG. 7 shows another example of the pixel P of FIG. 2 according to one embodiment.

Referring to FIG. 7, the pixel P according to one embodiment comprises an OLED, a driving TFT (DT), first to fourth switching TFTs (ST1 to ST2), a compensation capacitor Cgss, and a storage capacitor Cst.

The pixel P is identical to that of FIG. 2, except for a connection structure of the third switching TFT (ST3). Unlike in FIG. 2, the third switching TFT (ST3) of FIG. 7 switches the current path between the input terminal of reference voltage Vref and node A in response to the initialization signal INIT. The third switching TFT (ST3) is turned on to supply the reference voltage to node A rather than node B. Even if the reference voltage Vref is supplied to node A in the initialization period, the first switching TFT (St1) is turned on during the initialization period to transmit the reference voltage Vref of node A to node B. Accordingly, the operation of the pixel P of FIG. 7 is substantially identical to the pixel P of FIG. 2, regarding the sensing period, the programming period, and the emission period.

Figure 8:
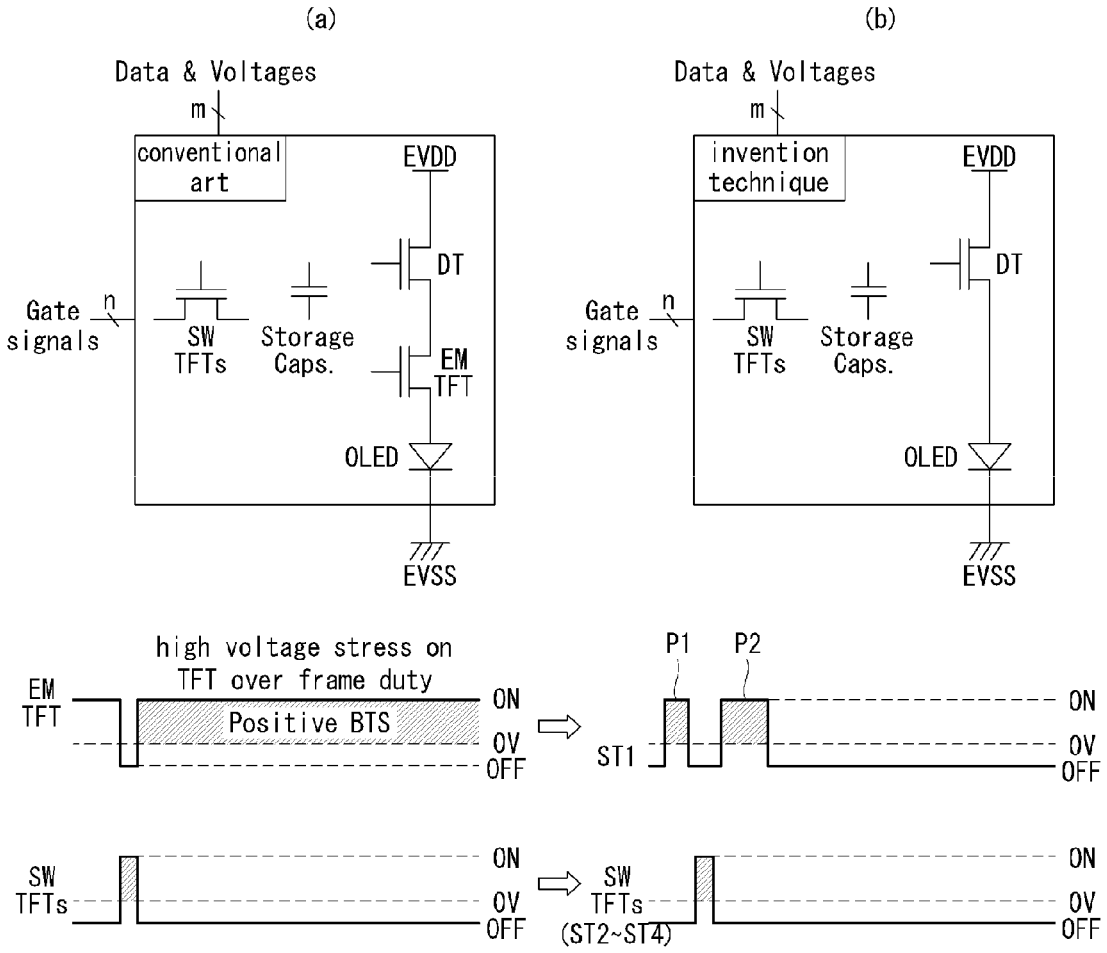
FIG. 8 shows a driving waveform of a gate signal of the present invention compared to the conventional art.
Figure 9:
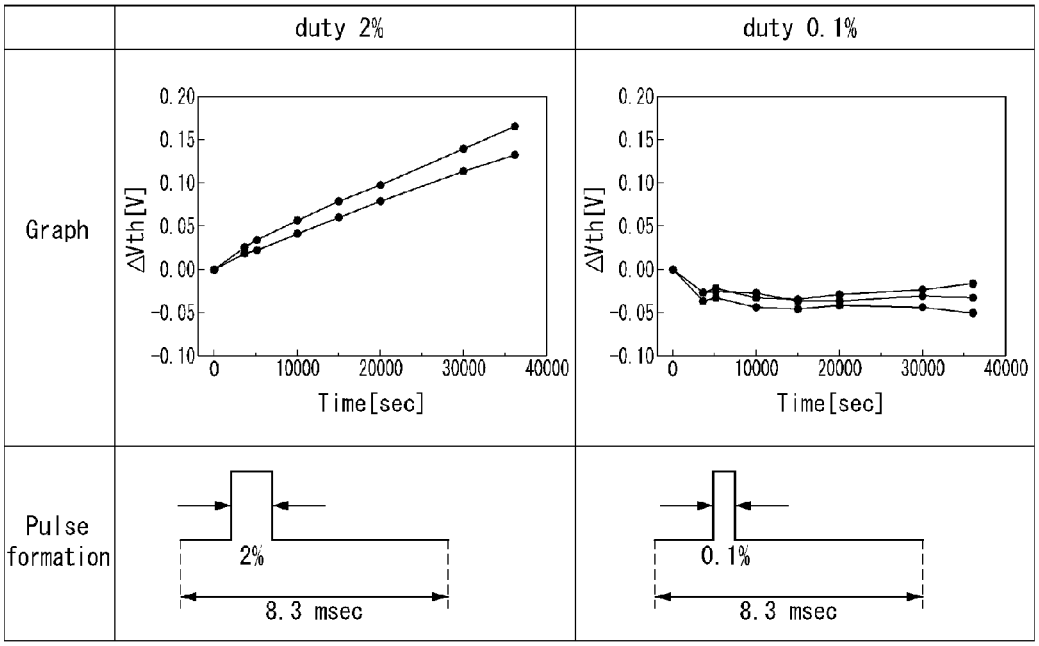
FIG. 9 shows the progress of threshold voltage degradation in accordance with the on duty of the gate signal.

FIG. 8 shows a driving waveform of a gate signal of the present invention compared to the conventional art. FIG. 9 shows the progress of threshold voltage degradation in accordance with the on duty of the gate signal.

Referring to (a) of FIG. 8, in a conventional pixel circuit, an EM TFT is connected between a driving TFT (DT) and an OLED to control light emission of the OLED. In the conventional art, SW TFTs are turned on prior to an emission period and turned off in the emission period, whereas the EM TFT is turned only during the emission period. The emission period is relatively much longer than the other periods, and an ON-level light emission control signal is applied to the gate of the EM TFT during the entire emission period. It is inevitable that the EM TFT is further deteriorated than the SW TFTs, due to a positive bias stress applied for a long time.

Referring to (b) of FIG. 8, in the embodiments of the pixel circuit herein, only the driving TFT (DT) and the OLED are serially connected between input terminals of cell driving voltages EVDD and EVSS, and the conventional EM TFT is not connected between these input terminals EVDD and EVSS. A light emission control signal is applied to the first switching TFT (ST1) for transmitting a data voltage to induce light emission, as explained above, and is in the form of two pulses. The first switching TFT (ST1) is turned on by first and second pulses P1 and P2 having the ON level respectively corresponding to the initialization period and the first emission period. Since the first switching TFT (ST1) is turned off in response to an OFF-level light emission control signal in the second emission period, deterioration of the first switching TFT (ST1) caused by a positive gate bias stress is greatly reduced. Even if the first switching TFT (ST1) is turned off in the second emission period, the condition of light emission of the first emission period is kept nearly the same due to the compensation capacitor connected between the gate and source of the driving TFT. Meanwhile, the OFF period of all the TFTs including the first switching TFT (ST1) in one frame is much longer than the ON period thereof. However, the absolute value of the off voltage level of gate signals is much smaller than the absolute value of the on voltage level thereof. Thus, any problem caused by a negative bias stress is not significant and also ignorable.

The progress of deterioration of the threshold voltage of a TFT in accordance with the on duty of a gate signal is as shown in FIG. 9. Referring to FIG. 9, if the frame frequency is 120 Hz, 1 frame period is approximately 8.3 msec. According to a test, it was found that the on duty of a gate signal (especially, light emission control signal) within one frame may be set to approximately 5% or less, the effect of preventing threshold voltage deterioration becomes larger as the on duty of the gate signal is set to a lower level within a predetermined range. For example, as shown in FIG. 9, if the on duty of the light emission control signal is set to 2%, the threshold voltage of the TFT operated by the light emission control signal gradually rises and becomes deteriorated with the elapse of driving time. On the other hand, if the on duty of the light emission control signal is set to 0.1%, the threshold voltage of the TFT is maintained nearly constant in spite of the elapse of driving time. In the embodiments herein, the ON period of the first pulse of FIG. 4 can be further reduced within the on period of the initialization signal to reduce the on duty of the light emission control signal as much as possible.

Figure 10:
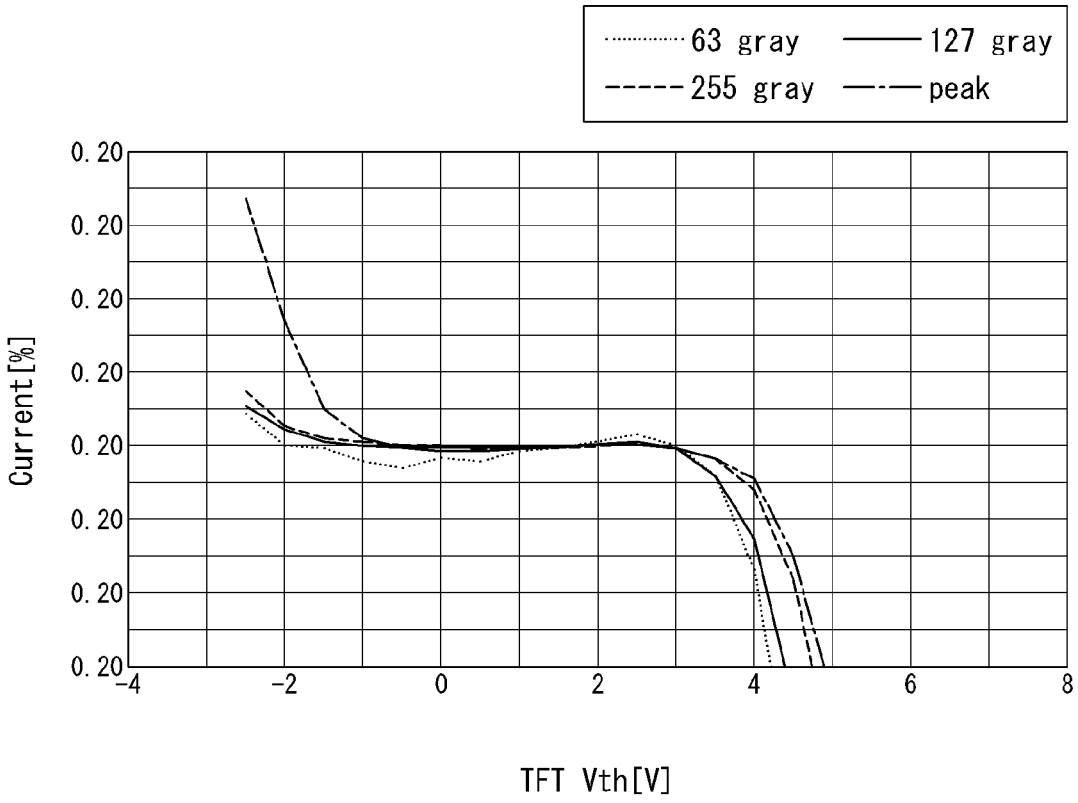
FIG. 10 shows the result of simulation of the threshold voltage compensation performance of the pixel of the present invention.

FIG. 10 shows the result of simulation of the threshold voltage compensation performance of the pixel of the present invention.

Referring to FIG. 10, according to the pixel circuit of the present invention, the threshold voltage compensation performance ranges from −2V to 4V, and the compensation range can be shifted, increased, or decreased according to power settings and how much the TFT and capacitor sizes are optimized. Especially, the threshold voltage compensation technique of the present invention exhibits excellent compensation performance even in low gray levels (63 gray), as shown in FIG. 10.

As described above, the organic light emitting display and driving method thereof according to the present invention has the following effects to overcome the problems occurring in the conventional art.

First, while the conventional compensation circuit method is limited to when the threshold voltage of a driving TFT has a positive value (or negative value), the present invention can detect a threshold voltage having a negative value, as well as a threshold voltage having a positive value, regardless of whether the TFT is the n-type or p-type by employing the source-follower method.

Second, in the conventional compensation circuit method a fixed potential is applied to the gate of the driving TFT upon sensing a threshold voltage whereas, in the present invention, the gate of the driving TFT is allowed to float upon sensing a threshold voltage, and the threshold voltage compensation capability is improved by using the compensation capacitor connected between the gate and source of the driving TFT and a parasitic capacitor of the driving TFT. The present invention increases the accuracy of threshold voltage compensation is increased by additionally amplifying the gate-source voltage of the driving TFT upon detecting a threshold voltage in consideration of distortion of threshold voltage compensation caused by the parasitic capacitor Third, while, in the conventional compensation circuit, the light emission control TFT which is turned on during the entire emission period is easily deteriorated whereas, in the present invention, deterioration of the switching TFTs to be switched in response to a gate signal can be minimized by minimizing the on duty of gate signals (especially, a light emission control signal). Reliability of the switching TFTS can be enhanced by minimizing deterioration caused by a gate bias stress.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting display comprising:

an organic light emitting diode;

a driving thin film transistor (TFT) comprising a first electrode connected to a first node, a second electrode connected to an input terminal of high-potential cell driving voltage, and a third electrode connected to the organic light emitting diode through a second node, and the driving TFT configured to control current through the organic light emitting diode;

a first switching TFT comprising a first electrode connected to a gate driver to receive a light emission control signal, a second electrode connected to a third node, and a third electrode connected to the first node and the first electrode of the driving TFT, the first switching TFT configured to provide a current path between the third node and the first node in response to the light emission control signal at a first light emission level;

a second switching TFT comprising a first electrode connected to the gate driver to receive an initialization signal, a second electrode connected to the second node and the third electrode of the driving TFT, and a third electrode connected an initialization voltage, the second switching TFT configured to initialize the second node to the initialization voltage by connecting the second node to the third electrode of the second switching TFT in response to the first electrode of the second switching TFT receiving the initialization signal at a first initialization level from the gate driver;

a third switching TFT comprising a first electrode connected to the gate driver to receive the initialization signal, a second electrode connected to the first node, the first electrode of the driving TFT, and the third electrode of the first switching TFT, and a third electrode connected to a reference voltage, the third switching TFT configured to initialize either the first node or the third node to the reference voltage that is higher than the initialization voltage in response to the first electrode of the third switching TFT receiving the initialization signal at the first initialization level from the gate driver;

a fourth switching TFT comprising a first electrode connected to the gate driver to receive a scan signal, a second electrode connected to a data line, and a third electrode connected to the third node and the second electrode of the first switching TFT, the fourth switching TFT configured to provide a current path between the data line and the third node in response to the first electrode of the fourth switching TFT receiving the scan signal from the gate driver when the fourth switching TFT is turned on;

a compensation capacitor including a first end and a second end, wherein the first end connected to the first node, the first electrode of the driving TFT, the third electrode of the first switching TFT, and the second electrode of the third switching TFT, and wherein the second end is connected to the second node, the second electrode of the second switching TFT, the third electrode of the driving TFT, and the organic light emitting diode, the compensation capacitor configured to store a threshold voltage of the driving TFT in response to the first switching TFT being turned off after the first electrode of the first switching TFT receives the light emission control signal at a second light emission level from the gate driver, the second switching TFT being turned off after the first electrode of the second switching TFT receives the initialization signal at a second initialization level from the gate driver, and the third switching TFT being turned off after the first electrode of the third switching TFT receives the initialization signal at the second initialization level from the gate driver, and the compensation capacitor being distinct from parasitic capacitance of the driving TFT; and a storage capacitor including a first end and a second end, the first end of the storage capacitor connected to the third node, the third electrode of fourth switching TFT, and the second electrode of the first switching TFT, and the second end of the storage capacitor connected to the second node, the second electrode of the second switching TFT, and the organic light emitting diode.

2. The organic light emitting display of claim 1, wherein during an initialization period of a frame the first node is initialized to the reference voltage, the second node is initialized to the initialization voltage, and third node is initialized to the reference voltage, and wherein during a sensing period of the frame the compensation capacitor stores the threshold voltage of the driving TFT, and wherein during a programming period of the frame a data voltage is applied to the third node, and wherein during an emission period of the frame the driving current applied to the organic light emitting diode is compensated using the threshold voltage and the data voltage; and wherein the first node floats during the sensing period.

3. The organic light emitting display of claim 2, wherein, during the sensing period, a potential of the second node rises to an intermediate source voltage based on a difference between the threshold voltage and a sum of the reference voltage and an amplification compensation factor voltage for preventing distortion of the threshold voltage, and wherein a potential of the first node rises to an intermediate gate voltage based on a sum of the reference voltage and the amplification compensation factor voltage.

4. The organic light emitting display of claim 3, wherein the value of the amplification compensation factor voltage is adjusted by a parasitic capacitor of the driving TFT.

5. The organic light emitting display of claim 3, further comprising an adjustment capacitor including a first end connected to the first node and a second end connected to the input terminal of the high-potential cell driving voltage, the adjustment capacitor configured to adjust the value of the amplification compensation factor voltage.

6. The organic light emitting display of claim 2, wherein the light emission control signal is at the first light emission level for a first duration during the initialization period and the light emission control signal is at the first light emission level for a second duration during the emission period.

7. The organic light emitting display of claim 6, wherein during a first emission period of the emission period a first driving current is applied to the organic light emitting diode and during a second emission period of the emission period a second driving current, which is lower than the first driving current, is applied to the organic light emitting diode, the second emission period longer than the first emission period.

8. The organic light emitting display of claim 6, wherein the first duration is shorter than the second period.

9. The organic light emitting display of claim 1, wherein the first electrode of the third switching TFT is connected to a signal line to which the initialization signal is supplied by the gate driver and the third electrode of the third switching TFT is connected to an input terminal of the reference voltage.

10. A driving method of an organic light emitting display comprising a driving thin film transistor (TFT) comprising a first electrode connected to a first node, a second electrode connected to an input terminal of high-potential cell driving voltage, and a third electrode connected to an organic light emitting diode through a second node, and the driving TFT controlling the current applied to the organic light emitting diode, a first switching TFT configured to provide the current path between a third node and the first node in response to a light emission control signal, a second switching TFT configured to initialize the second node to an initialization voltage in response to an initialization signal, a third switching TFT configured to initialize either the first node or the third node to a reference voltage that is higher than the initialization voltage in response to receiving the initialization signal, a fourth switching TFT configured to provide the current path between a data line and the third node in response to receiving a scan signal, a compensation capacitor connected between the first node and the second node, the compensation capacitor distinct from a parasitic capacitance of the driving TFT between the first node and the second node, and a storage capacitor connected between the third node and the second node, the method comprising:

turning on the second switching TFT in response to a first electrode of the second switching TFT receiving the initialization signal at a first initialization level from a gate driver, the second node connected to a second electrode of the second switching TFT and the second node initialized to the initialization voltage connected to a third electrode of the second switching TFT by connecting the second node to the third electrode of the second switching TFT;

turning on the third switching TFT in response to a first electrode of the third switching TFT receiving the initialization signal at the first initialization level from the gate driver and turning on the first switching TFT in response to a first electrode of the first switching TFT receiving the light emission control signal at a first light emission control level from the gate driver, the first node connected to a second electrode of the third switching TFT and to a second electrode of the first switching TFT, and the first node initialized to a reference voltage that is connected to a third electrode of the third switching TFT by connecting the first node to the third electrode of the third switching TFT;

turning off the first switching TFT in response to the first electrode of the first switching TFT receiving the light emission control signal at a second light emission level and turning off the second switching TFT and the third switching TFT in response to the first terminal of the second switching TFT and the first terminal of the third switching TFT receiving the initialization signal at a second initialization level, the first switching TFT, the second switching TFT, and the third switching TFT being turned off causing the supply of the initialization voltage to the second node to stop and the first node to float;

storing a threshold voltage of the driving TFT in the compensation capacitor in response to the first switching TFT, the second switching TFT, and the third switching TFT being turned off, wherein a first end of the compensation capacitor is connected to the first node, the first electrode of the driving TFT, the second electrode of the first switching TFT, and the second electrode of the third switching TFT, and wherein a second end of the compensation capacitor is connected to the second node, the second electrode of the second switching TFT, and the third electrode of the driving TFT;

turning on the fourth switching TFT in response to a first electrode of the fourth switching TFT receiving the scan signal from the gate driver, the third node connected to a second electrode of the fourth switching TFT and the storage capacitor, and the third node receiving a data voltage connected to a second electrode of the fourth switching TFT by connecting the third node to the second electrode of the fourth switching TFT; and turning on the first switching TFT in response to the first electrode of the first switching TFT receiving the light emission control signal at the first light emission control level, a third electrode of the first switching TFT connected to the third node and the first node receiving the data voltage by connecting the third electrode of the first switching TFT to the first node to compensate for driving current applied to the organic light emitting diode and causing the organic light emitting diode to emit light.

11. The method of claim 10, wherein storing the threshold voltage comprises the potential of the second node rising to an intermediate source voltage based on a difference between the threshold voltage and a sum of the reference voltage and an amplification compensation factor voltage for preventing distortion of the threshold voltage and wherein a potential of the first node rises to an intermediate gate voltage based on a sum of the reference voltage and the amplification compensation factor.

12. The method of claim 11, wherein the value of the amplification compensation factor voltage is adjusted by a parasitic capacitor of the driving TFT.

13. The method of claim 10, wherein the light emission control signal is at the first light emission level for a first duration during an initialization period and the light emission control signal is at the first light emission level for a second duration during an emission period.

14. The method of claim 10, wherein during an emission period in which the organic light emitting diode emits light; and wherein the emission period comprises a first emission period in which the organic light emitting diode emits light by a first driving current and a second emission period in which the organic light emitting diode emits light by a second driving current, the second emission period being longer than the first emission period.

* * * * *